US005607156A

United States Patent [19]

Samarasinghe

[11] Patent Number: 5,607,156

[45] Date of Patent: Mar. 4, 1997

[54] APPARATUS FOR PLAYING GAMES

[76] Inventor: Amaradivakara-Sam Samarasinghe, RSGC View, D2-0-7, Kuala Lumpur 55100, Malaysia

[21] Appl. No.: 256,536

[22] PCT Filed: Jan. 18, 1993

[86] PCT No.: PCT/GB93/00106

§ 371 Date: Oct. 18, 1994

§ 102(e) Date: Oct. 18, 1994

[87] PCT Pub. No.: WO93/13839

PCT Pub. Date: Jul. 22, 1993

[30] Foreign Application Priority Data

Jan. 16, 1992 [GB] United Kingdom ..... 9200862
Sep. 21, 1992 [GB] United Kingdom ..... 9219947

[51] Int. Cl.[6] ..... A63F 3/00

[52] U.S. Cl. ..... 273/146; 273/283; 273/236; 273/276; 434/304

[58] Field of Search ..... 273/146, 236, 273/272, 276, 283, 284, 299, 268; 434/304

[56] References Cited

U.S. PATENT DOCUMENTS

| | | | |
|---|---|---|---|
| 802,807 | 10/1905 | Fitch | 434/304 |
| 1,425,264 | 8/1922 | Loeb | 434/304 |
| 2,647,330 | 8/1953 | Ford | 434/304 |
| 2,853,804 | 9/1958 | Bengeyfield | 434/304 |
| 3,022,582 | 2/1962 | Pitt | 434/304 |
| 3,195,895 | 7/1965 | Kropinski | 273/146 |
| 4,368,045 | 1/1983 | Kuh | 434/304 |
| 4,489,946 | 12/1984 | Ortiz Burgos | 273/249 |
| 4,690,409 | 9/1987 | Scalia | 273/299 |
| 4,817,959 | 4/1989 | Tinsley | 273/249 |

FOREIGN PATENT DOCUMENTS

| | | | |
|---|---|---|---|
| 1402037 | 5/1965 | France | 434/304 |
| 2462918 | 3/1981 | France | 273/268 |
| 3305673 | 8/1984 | Germany . | |
| 8807740 | 12/1988 | Germany . | |
| 11784 | 7/1910 | United Kingdom . | |
| 2069218 | 8/1981 | United Kingdom | 434/304 |
| 2263237 | 7/1993 | United Kingdom | 434/304 |

*Primary Examiner*—Benjamin H. Layno
*Attorney, Agent, or Firm*—Birch, Stewart, Kolasch & Birch, LLP

[57] ABSTRACT

Apparatus for playing games relating to time comprises one or two dice and a clock. The dice are dodecahedral. One dice represents hours and has its facets numbered from 1 to 12. The other dice represents minutes and is numbered at intervals of 5 from 5 to 60. The clock is made up of a central circular core and twelve sector-shaped outer segments. Various games can be played with the apparatus.

21 Claims, 6 Drawing Sheets

FIG. 9

| | | | |
|---|---|---|---|
| 1 HOURS | 2 HOURS | 3 HOURS | 4 HOURS |
| 1+ | 2x | 3+ | 4+ |
| 5 HOURS | 6 HOURS | 7 HOURS | 8 HOURS |
| 5x | 6÷ | 7- | 8+ |
| 9 HOURS | 10 HOURS | 11 HOURS | 12 HOURS |
| 9- | 10x | 11- | 12÷ |

FIG. 10

| | | | |
|---|---|---|---|
| 0 MINUTES | 5 MINUTES | 10 MINUTES | 15 MINUTES |
| 2 | 1 | 6 | 3 |
| 20 MINUTES | 25 MINUTES | 30 MINUTES | 35 MINUTES |
| 2 | 6 | 2 | 3 |
| 40 MINUTES | 45 MINUTES | 50 MINUTES | 55 MINUTES |
| 1 | 3 | 6 | 1 |

APPARATUS FOR PLAYING GAMES

BACKGROUND AND SUMMARY OF THE INVENTION

The present invention relates to an apparatus for playing games, especially but not exclusively, games relating to time.

According to the present invention, in one aspect, there is provided an apparatus for playing games comprising at least one die and a planar object, with markings thereon, characterised in that the die has twelve facets, each facet having markings to indicate numerals and/or letters of the alphabet and/or other characters, and the planar object comprises at least twelve parts capable of being assembled into a composite planar sheet, each part having makings to indicate numerals and/or letters and/or characters corresponding to the facets on the die.

According to the present invention in another aspect there is provided apparatus for playing games relating to time, comprising two dice and a clock face, each die having twelve facets uniformly distributed around its center point, one of the dice having its facets marked to indicate twelve numbers at intervals of one unit, the other die having its facets marked to indicate twelve numbers at intervals of five units, the clock face being marked from 1 to 12 to indicate hours and also from 1 to 60, at least at intervals of 5 per facet to indicate minutes.

The first die represents an "hour die" and its facets may be marked 0 to 11 or 1 to 12. The second die represents a "minute die" and its facets may be marked 0 to 55, or 5 to 60 at intervals of 5.

The die may be formed in a dodecahedron. They may have pentagonal facets with straight edges between-adjacent facets, or they may have facets of other shapes, for example, circular, with curved transitions between adjacent facets.

The clock face may be made up of pieces which fit together. It may include twelve sector pieces, each marked to indicate an hour 1 to 12. The clock face may include a central piece. The sector pieces may include interlocking portions along their adjacent radial edges, for example, tongue and groove. The sector pieces may also include means for interlocking with the central piece. The central piece may be circular.

The clock may include an hour hand and a minute hand for indicating the time. The hands may be attached to the central circular piece.

Alternatively the clock may be formed by a tray with clock pieces that fit into the tray. The tray may have an outer wall and an inner wall and the clock face pieces fit into the space between the inner and outer walls.

The apparatus may also include sets of numbered cards. Each set may be distinct from the others, for example by being coloured a different colour. In one embodiment there are six sets coloured, for example, red, green, blue, yellow, brown and black. The cards may be numbered in a binary progression. There may be 10 cards in each set numbered 1, 2, 4, 8, 16, 32, 64, 128, 256 and 512. These cards are used to keep the score of each player. Any number from 1 to 1023 may be formed by combinations of these cards.

In an alternative embodiment there are twelve 'hour' cards and twelve 'minute' cards, each card being marked with a number corresponding to a number on a facet of one of the dice. The 'hour' and 'minute' cards may also be marked with symbols for mathematical functions, such as "+", "−", "×" and "÷".

The apparatus may also include sets of chips identified in the same manner as the cards. For example there may be six sets of five chips, the sets being coloured red, green, blue, yellow, brown and black.

Alternatively or in addition, the apparatus may be provided with pegs which fit into holes in the clock face.

A cup may be provided as a shaker for the dice.

Although in some games the hour die is used to represent hours, it could be used in other games to indicate months of the year, ie. January=1, February=2, etc.

The 'minute' die can likewise be used to represent seconds instead of hours.

Although in the arrangement described above the apparatus is marked with numerals for playing games relating to time, the die and clock and the scoring cards may be marked additionally or alternatively with letters of the alphabet or other characters, for playing other games.

The apparatus of the present invention can be used for playing many different games, examples of which will be described below.

BRIEF DESCRIPTION OF THE DRAWINGS

Embodiments of the invention will now be described, by way of example, of wherein.

FIG. 9 shows hour cards for the apparatus of the present invention;

FIG. 10 shows minute cards for the apparatus of the present invention;

DETAILED DESCRIPTION OF THE INVENTION

Figure 1:
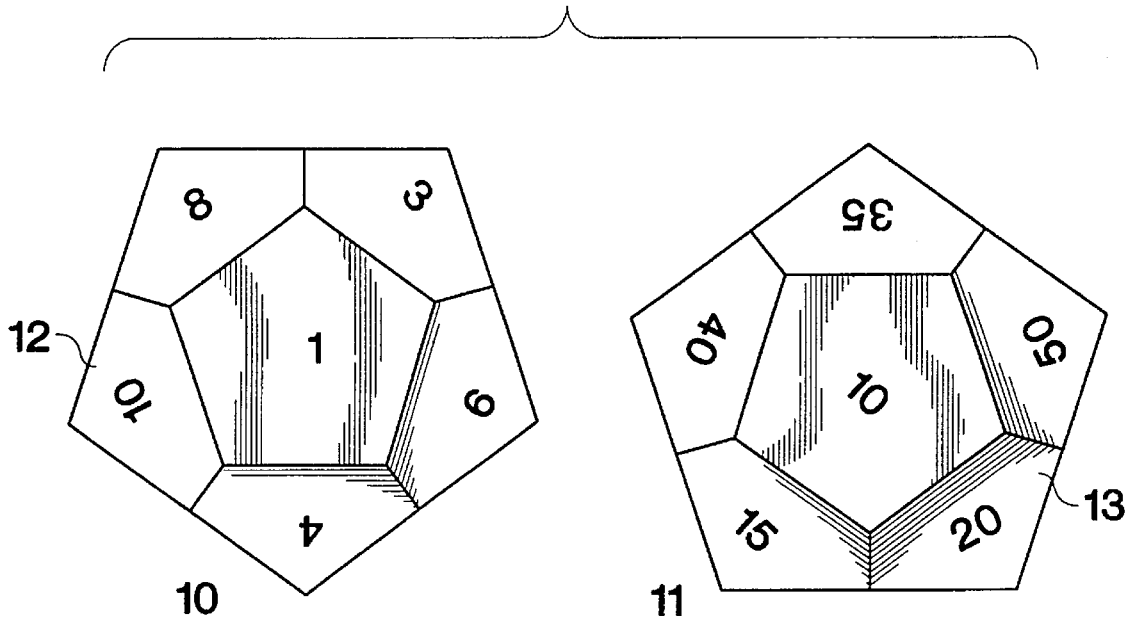
FIGS. 1 and 1A show dice of the game apparatus in accordance with the present invention.
Figure 1A:
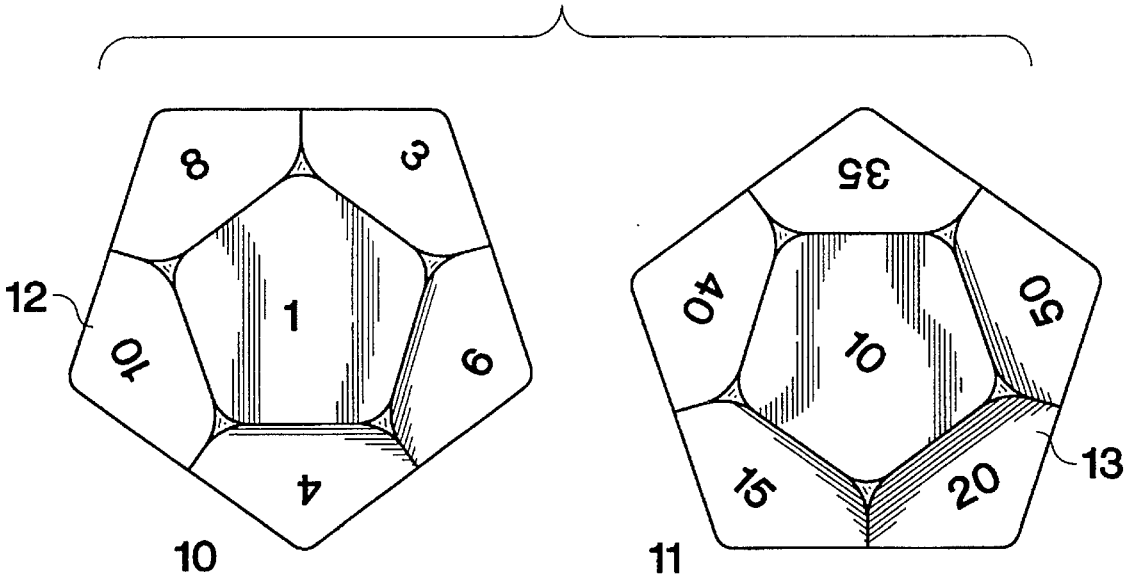

Referring to FIGS. 1 and 1A, these drawings show two dodecahedral dice 10 and 11 of the game apparatus in accordance with the present invention. The die 10 has twelve facets 12 marked with numbers 1 to 12. The die 11 has twelve facets 13 marked with numbers 0, 5, 10, 15, 20, 25, 30, 35, 40, 45, 50 and 55. Each facet is in the shape of a pentagon with a straight edge transition between adjacent facets.

Figure 2:
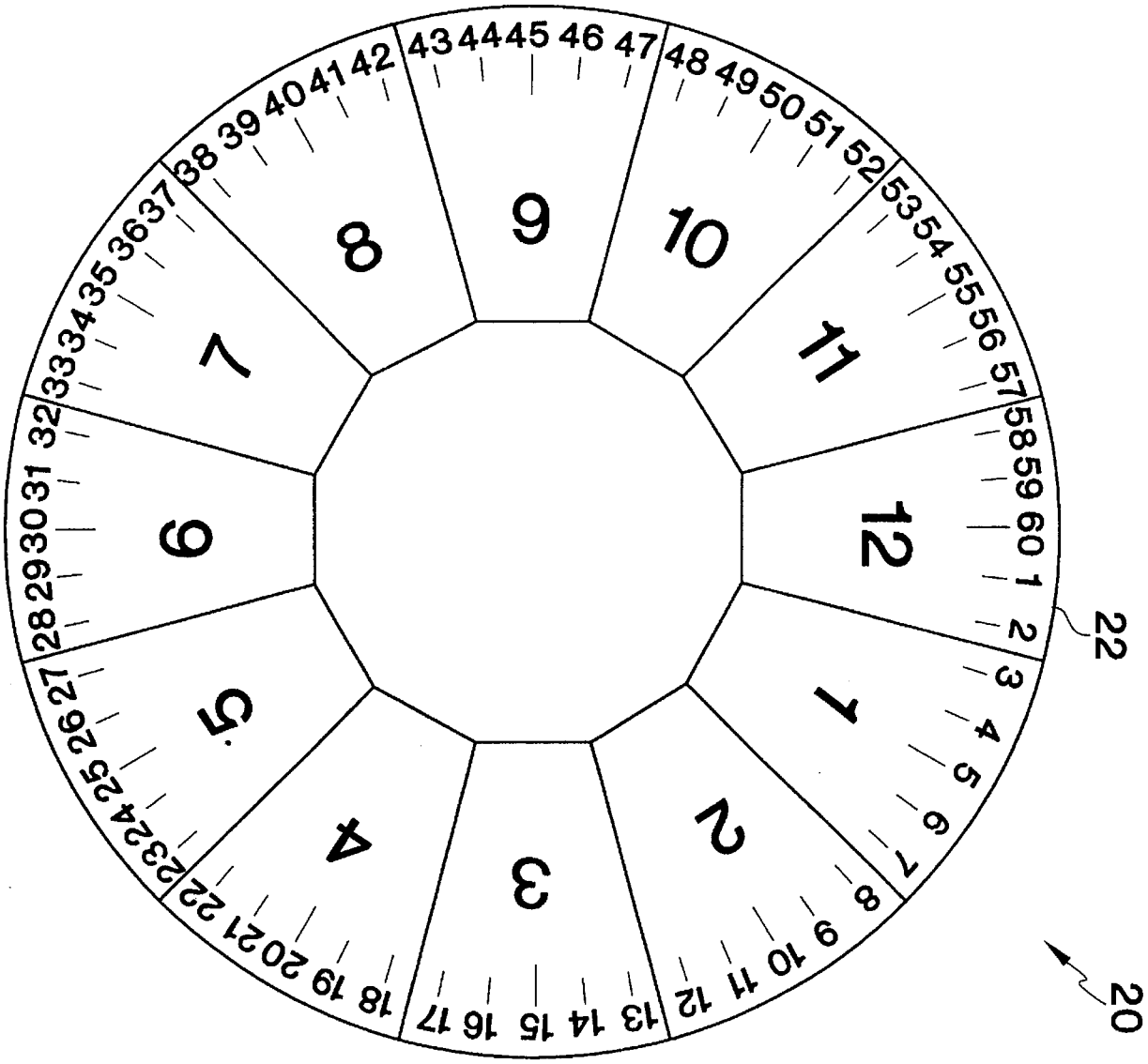
FIG. 2 shows a front view clock face of the game apparatus in accordance with the present invention.
Figure 3:
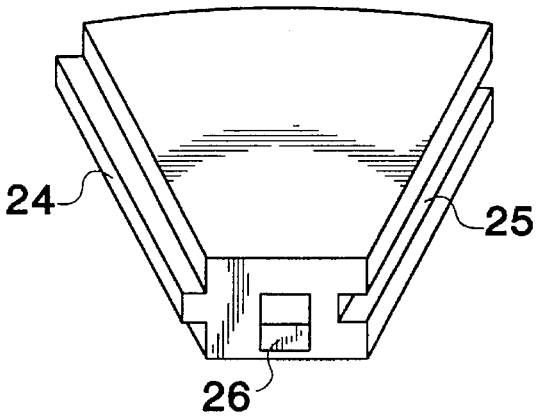
FIG. 3 shows a perspective view of sector pieces of the clock face of FIG. 2.
Figure 4:
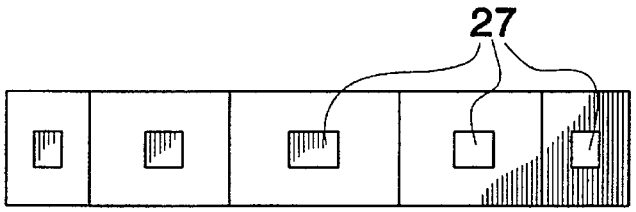
FIG. 4 shows a side view of the central piece of the clock face of FIG. 2.

FIGS. 2, 3 and 4 show a clock of the game apparatus in accordance with the present invention. The clock 20 has a face 21 marked with hours, 1 to 12 and with minutes 0 to 59 as a conventional clock face. Although the embodiment shown shows all the minutes numbered, in other embodiments the minutes numerals are only shown at 5 minute intervals, 5, 10, 15 etc.

The clock face is made up of thirteen pieces, a central circular piece 22 and twelve sector pieces 23. Each section bears a numeral for one of the hours. The central piece carries an hour hand and a minute hand for indicating the time (not shown). The thirteen pieces of the clock face fit together. Each sector has a tongue 24 along one of its radial edges and a groove 25 along the other. The tongue of one sector fits into the groove of the adjacent sector when the pieces of the clock are assembled.

The inner edge of each sector piece 23 has a peg 26 which fits into a corresponding slot 27 in the periphery of the circular piece 22. The central piece is used to join any number of sector pieces together as a unit.

Although in the embodiment the clock is shown to have a central portion, this could be omitted and the clock could consist of 12 pieces, with the sector pieces extending to the center of the circle.

FIGS. 5 to 8 show an alternative construction of clock face. The clock face 40 comprises a tray 41, preferably moulded from plastics material, having a flat base portion 42 with a raised outer wall 43 and an inner wall 44 forming a central boss which may have a flat portion 45 on which the hands 39 of the clock may be mounted by means of a plastic nut and bolt 49. The inner and outer walls 44 and 43 are 12-sided.

Figure 7:
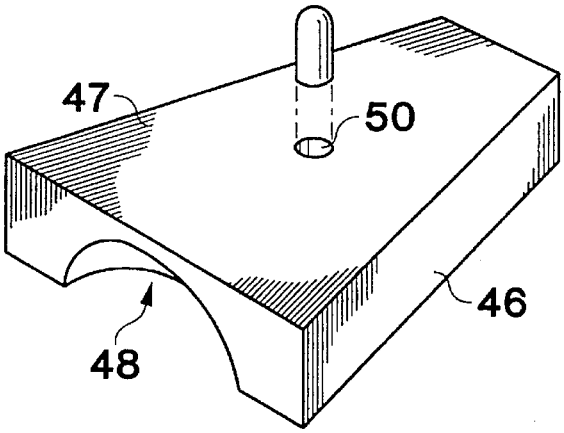
FIG. 7 shows perspective view of piece of the clock face of FIG. 5.
Figure 5:
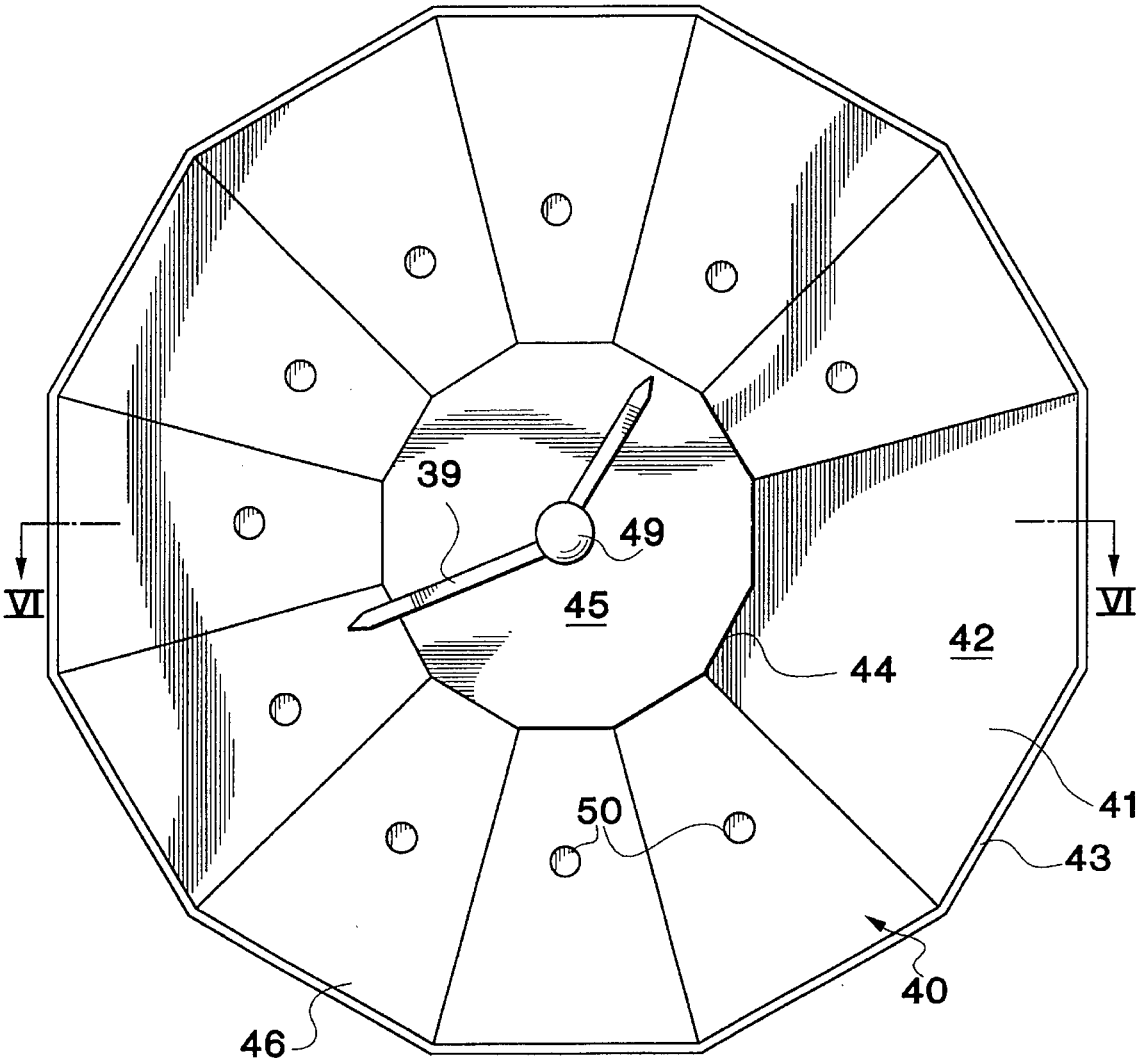
FIG. 5 shows a plan view of an alternative clock face of the present invention with some parts removed.
Figure 6:
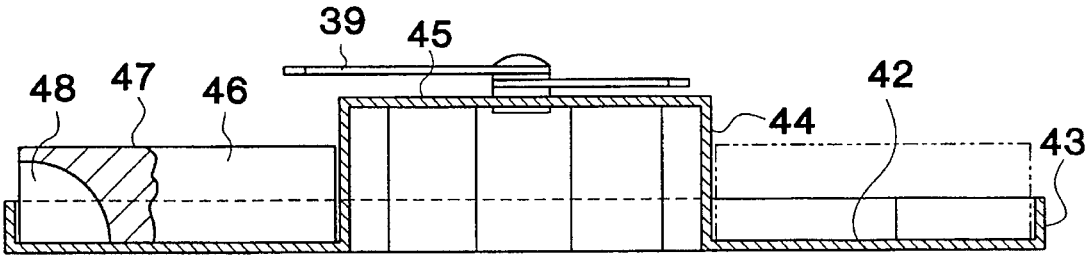
FIG. 6 shows a section or the line VI—VI of FIG. 5.

FIG. 7 shows a perspective view of one of the twelve wedge-shaped portions 46 which make up the clock face. The twelve wedge shape portions fit together in the tray 41 in a circle around the boss, with their outer ends fitting inside the outer wall 43. In FIG. 5 some of the portions 46 have been left out. The top surface 47 of the wedge-shaped portions projects above the outer wall, and a curved recess is formed in the outer edge of the portions to receive a finger to enable the portions to be easily lifted out of the tray.

Holes 50 are formed in the wedge-shaped portions 46 to receive cylindrical pegs (not shown) which are additional playing piece for the game. One hole is formed in each portion.

Figure 8:
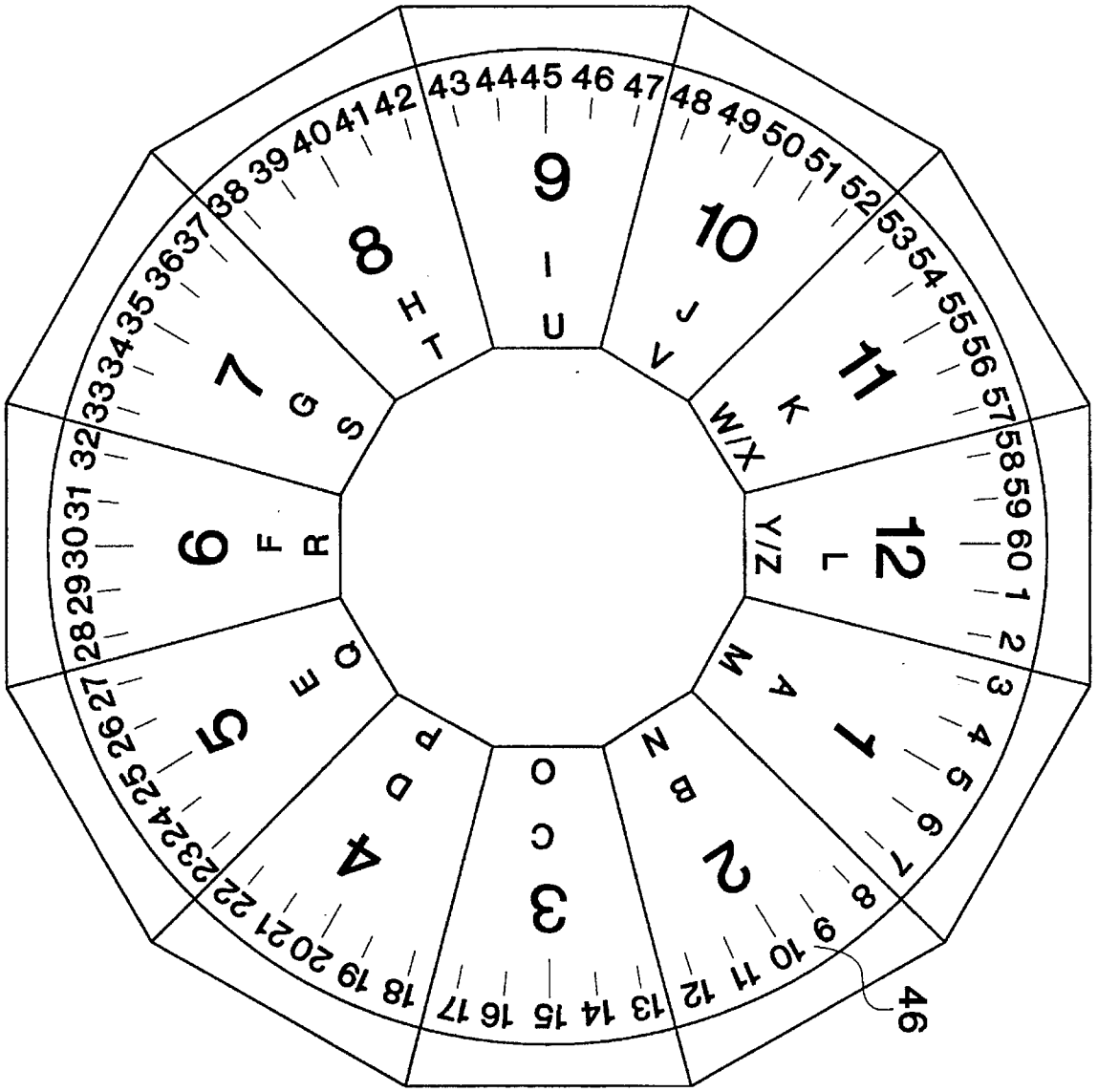
FIG. 8 shows the decorative finish that might be applied to the clock face of FIG. 5.

FIG. 8 shows a typical face that may be applied to the clock. The clock face is marked with numerals 1 to 12 corresponding to the numeral 1 to 12 which appear on the facets of the 'hour' die, and with numerals 0 to 59 corresponding to minutes which are only represented in steps of 5 on the minute die. One 'hour' numeral and five 'minute' numerals appear on each portion of the clock face.

The clock face may have letters of the alphabet in addition to the numerals for hours and minutes, on each portion of the clock face. The two letters appear on each portion except for two portions where the letters W & X and Y & Z are doubled up. The dice are also marked with letters in addition to numbers with a different letter on each of the twenty-four facets of the two dice, the W & X and Y & Z being on the same facets. Thus, for example, one die will be marked with A, B, C, D, E, F, G, H, I, J, K, L and the other with M, N, 0, P, Q, R, S, T, U, V, W/X, Y/Z.

In other versions of the apparatus, the numerals may be omitted from the dice and only letters or other characters may appear on their facet.

FIGS. 9 and 10 show 'hour' cards and 'minute' cards that may be used with the other apparatus to play games. There are 12 hour cards and 12 minute cards. There is one 'hour' card corresponding to each facet of the 'hour' die and one 'minute' card corresponding to each facet of the 'minute' die and the cards are marked accordingly. In addition, each 'hour' card is marked with a scoring number and a mathematical operator for example, the '7 hours' card may be marked "7-". The minute cards are marked with scoring numbers, for example, the '20 minute' card may be marked "2".

Using the cards the score may be recorded as follows. Let us suppose the dice are thrown and show 7 hours and 20 minutes. The score cards for 7 hours and 20 minutes are placed side by side. The score is calculated: 7–2=5. The score is therefore 5. Not all games require the score cards to be used.

The apparatus may also include pegs as mentioned above. 24 pegs may be provided and they may be marked in two different colours, for example 12 red and 12 white.

The following are examples of games that can be played with the apparatus described above.

12 O'Clock

This is a game that can be played with 2 to 6 players.

The clock 20 is first set at 12 o'clock. The first player throws the dice 10 and 11. Supposing the dice 10 shows 3 and the dice 11 shows 20 indicating 3 hours 20 minutes, the clock is set at 3 hours 20 minutes. The next player throws and the time indicated by his throw is added to the time already on the clock. Thus if his throw indicates 7 hours 50 minutes, the clock is advanced to be set at 11 hours 10 minutes. Play continues in this way, each player adding his time to the time shown on the clock.

Players score as follows. If at the end of his go the minute hand comes to the 15, 30 or 45 minutes position, the player scores 1 hour. If at the end of his go the minute hand comes to the 60 minute position the player scores the number hours indicated by the hour hand. For example, if the minute hand is at 60 minutes and the hour hand is 7, the players scores 7 hours.

120 Minutes

This is a game suitable for 2 players and only the 'minute die' 11 is used.

The first player throws the die and he removes the sector piece 22 of the clock corresponding to the number he has thrown. For example, if the die shows 35, he removes the piece that bears 35 minutes.

Play continues with the players removing the sector pieces from the clock corresponding to the numbers thrown. If the piece corresponding to the number thrown has already been taken by his opponent, the player takes the piece from his opponent. If he has already taken the piece himself he merely keeps it.

Play continues until one player has accumulated pieces of the clock totalling 120 minutes. Only the minutes at 5 intervals, ie. 5, 10, 15 . . . etc. count towards the score.

The numbered cards marked may be used for keeping the score.

48 Hours

This is a game similar to 120 minutes but the 'hour die' is used instead of the minute die and the game is won by the first player to accumulate pieces amounting to 48 hours in value.

100 Hours

This is a game for two players using the 'hour die' only.

The players start with all twelve hour sector pieces 22 removed from the clock face. Only the central circular piece 23 is in place. The first player throws the die and sets the sector piece 22 of the clock that corresponds to the number thrown, in place. The game continues until a player gets two or more adjoining parts of the clock together. If a player places the piece numbered 10 when the piece numbered 9 is already laid he scores (9+10)=19. If he places the piece numbered 7 when the pieces numbered 6 and 8 are already laid he scores (6+7+8)=21. If a player places the piece numbered 7 when the pieces numbered 8, 9 and 10 are already laid he scores (7+8+9+10)=34.

If the number on the die is already laid, the player loses that number from his score and the corresponding piece is removed from the clock. For example, if the player throws 10 and the piece numbered 10 is already laid, he must deduct 10 from his score and remove the piece numbered 10 from the clock.

The first player to score 100 wins the game. The numbered cards are used for keeping score.

STAR-WARS

This is a game for 2 to 6 players. The clock face is complete.

Each player is given five chips. The first player throws the hour die. If he throws 7 one of his chips is placed at 7 on the clock face. The next player throws the die and a chip is placed at the hour corresponding to his throw. Play goes on and if a chip comes to a space occupied by another chip, this chip is discarded and the new chip takes its place. Then the owner of the discarded chip must use a new chip when it comes to his turn to play. If a player has a chip on the clock, when he throws the die again he must move his chip clockwise according to the figure shown on the die. If a player throws 9 and his chip is at 7, his chip must move clockwise 9 positions to 4. At any given time a player may have only one chip on the clock.

A player can move his chip anti-clockwise only if by doing so he could displace another player's chip. For example, if a chip is at 6 and the die shows 4 the chip could move either to 10 or 2 only if there is another chip at 2. If there is a chip at 10 he must move clockwise and replace that chip. If the player has a choice of displacing other players chips both clockwise and anti-clockwise directions, must move only clockwise direction. Always move chip clockwise unless it can move anti-clockwise and occupy a position occupied by another player.

When a player has lost all five chips he is out of the game. The play continues until all the players except one are out of the game. The number of chips retained by the last player is his score. This may be anything from 1 to 5.

If necessary a number of games could be played until a player scores say 10, 15 or 25 points. This should be decided before the first game.

The apparatus of the present invention can also be used in solving a number of puzzles, of which the following are examples.

Q1. How many times does the minute-hand pass over the hour-hand in a 24 hour day?

Answer: Not 24 times, only 22 times. Observe the clock very carefully.

Q2. Assume the hour-hand is moving in the clock-wise direction and minute-hand moving in the anti-clockwise direction. How many times does the minute-hand pass over the hour-hand during a 24-hour day?

Answer 26 times. You may try this with the clock.

Q3. If the minute-hand is moving in the clock-wise direction and hour-hand is moving in the anti-clockwise direction. How many times does the minute-hand pass over the hour-hand in a 24-hour day?

Answer 26 times.

Q4. The clock face is to be broken into 6 parts. The numbers in each part are added to form 6 sums. The difference between any two of the sums is found to be a multiple of 4. How is the clock-face divided?

Answers (1+2), (3+4), (5+6), (7+8), (9+10) and (11+12) or (2+3), (4+5), (6+7), (8+9), (10+11) and (12+1).

Q5. The clock face is divided into four parts. The numbers in each part are added to form 4 sums. The difference between any two of the 4 sums is found to be a multiple of 9. How is the clock face divided?

Answer (1+2+3), (4+5+6), (7+8+9), and (10+11+12).

Q6. The clock face is divided into 3 parts. The numbers in each part are added to form 3 sums. The difference between any 2 sums is a multiple of 8. Show how the clock face is divided.

Answer (3+4+5+6), (7+8+9+10) and (11+12+1+2).

Q7. Starting with the complete clock face and at the number 1 on the face. Count in a clockwise direction and remove the third figure, ie. remove hour 3. Then start with the next figure. Keep on doing this until only one figure is left on the clock. Finally the piece with hour 10 will remain in the clock.

Start with 1 and count a certain figure and remove that piece. Then start with the next figure and repeat the process. If the last figure remaining on the clock face is hour 12, what is the figure to be counted?

Answer Count 14. Even if you count 35 you will find the last piece remaining in the clock is hour 12.

Q8. If you start with 1 and count a certain number and repeat the procedure as before the last piece remaining in the clock is hour 10. Can you find the lowest number to be counted? The number is not 3.

Answer 23.

The following are examples of games that can be played with the alternative clock.

The games 12 O'clock, 120 minute, 48 hours and 100 hours could be played using the alternative clock except that the score should be recorded on a piece of paper. Further all the puzzles could be solved using the alternative clock. The following are examples of additional games that can be played with the alternative clock.

Beat the hour

This game is played by two or more players.

Arrange pegs of any color in the clock, leaving the hour 12, empty. Now, move a peg over an adjoining one and remove the stationary peg.

NOTE: Since only the hour 12 is empty, you have to begin the game at either the hour 2 or the hour 10. Each peg can move over only an adjoining peg.

Keep repeating the process until only one peg remains in the clock.

If you find the above game is too simple remove the pegs so that only the peg at the hour 6 remains in the clock.

Now you may decide which peg to be remained on the clock. Try to remove all the other pegs.

This puzzle may be played as a game by taking down the time taken by each player to complete the puzzle.

On The Minute

This game is played by two to six players. Only the minute die is used.

a. The first player throws the minute die. If the die shows 20 minutes, a peg is placed at 20.

b. The next player throws the die and the number of minutes indicated by his throw is added to the time already on the clock. Thus, if the throw indicates 25 minutes, the peg is moved to 55.

c. The players score as follows: When the peg is positioned at the end of each throw, the player checks the score card for his score.

Example: If the peg is at 50, the player's score in the corresponding score card is 6.

The first player to score 40 points wins the game.

Lucky hour

This game is played by two to six players. Only the two dice and the score cards are used.

a. Each player take turns to throw the dice. If the dice indicate 5 hours 40 minutes, then the score, according to the corresponding score cards, is {5×1}=5. If the dice indicate 7 hours and 25 minutes, the score is {7−6}=1.

b. The first player to score 50 points wins the game.

3. On the hour

This game is played by two players a. Each player throws the hour die and places a peg on the hour indicated by the die. The two players must use different coloured pegs.

b. If player A's die shows an hour occupied by player B, player B's peg will be replaced by player A's peg. If the die shows an hour already occupied by the same player the peg will remain there.

c. The first player who gets his pegs on four (4) consecutive hours wins the game. The score is equal to the sum of the four (4) hours.

Example: if the pegs are at 6, 7, 8 and 9, the score is 30.

The game will proceed until a player reaches a pre-set score, say, 100.

Off the clock

This game is played by two to six players.

a. Fill the 12 hours of the clock with pegs of the same colour.

b. The first player throws the hour die. The player must remove the pegs corresponding to the number on the hour die or a number of pegs totalling the same number. If the hour die shows 8, any one of the following combination of pegs can be removed.

a. 8
b. 1+7
c. 2+6
d. 3+5
e.1+2+5
f. 1+3+4

The same player continues until the die shows a number where pegs can't be removed. The player's score is the total of the numbers indicated by the locations where the peg have been removed. The player with the highest number of points after five rounds wins the game.

Round the clock

This game is played by two to six players.

Each player takes turns to throw the hour die until the die shows 1. Then a peg is placed at 1 and that player scores 1. The players continue to take turns to throw the hour die until a player throws 2. Then the peg is moved to 2 and that player scores 2. The game continues until the peg moves to 12. The player with the highest score wins the game.

It will be appreciated that there is a large number of other games and puzzles that can be played using apparatus in accordance with the present invention.

I claim:

1. An apparatus for playing games comprising at least one die and a planar object with markings thereon, each of said dice consisting essentially of twelve facets, each facet having markings to indicate numerals and/or letters of the alphabet and/or other characters, and the planar object comprising at least twelve parts capable of being assembled into a composite planar sheet, each part having markings of numerals and/or letters and/or characters corresponding to the facets on the die.

2. The apparatus according to claim 1, and including two dice, each die having twelve facets.

3. The apparatus according to claim 2, in which one of the dice has its facets marked 0 to 11 or 1 to 12.

4. The apparatus according to claim 1 in which the planar object is a clock face.

5. The apparatus according to claim 4 in which the clock face includes an hour hand and a minute hand.

6. The apparatus according to claim 4, in which the clock face is formed of a tray and the twelve parts of the clock face fit into the tray.

7. The apparatus according to claim 6, in which the tray has an outer wall and an inner wall and the clock face pieces fit with the space between the inner and outer walls.

8. The apparatus according to claim 4, in which one of the dice has its facets marked from 0 to 55 or 5 to 60 at intervals of 5.

9. The apparatus according to claim 1, comprising two dice and further including twelve hour cards and twelve minute cards, each hour card being marked with a number corresponding to a number on a facet of one of the dice and each minute card being marked with a number corresponding to a number on a facet of the other dice.

10. The apparatus according to claim 9, in which the hour and/or minute cards are also marked with a symbol for a mathematical function.

11. The apparatus according to claim 1 further including a plurality of pegs, the twelve pieces of the object or clock being each provided with a hole for receiving the pegs.

12. The apparatus according to claim 1 further including a number of cards which is a multiple of twelve and comprising numbers and/or letters of the alphabet and/or characters in combination with/without mathematical signs.

13. The apparatus for playing games relating to time, comprising two dice and a clock face, each die having twelve facets uniformly distributed around its center point, one of the dice having its facets marked to indicate twelve numbers at intervals of one unit, the other die having its facets marked to indicate twelve numbers at intervals of five units, the clock face being marked from 1 to 12 to indicate hours and from 5 to 60 or 0 to 55, at least at intervals of 5, to indicate minutes.

14. The apparatus according to claims 13, in which the clock face comprises pieces which fit together.

15. The apparatus according to claim 13 in which the clock face includes a central piece.

16. The apparatus according to claim 15 in which the clock face includes 12 sector pieces, each marked to indicate an hour, 1 to 12.

17. The apparatus according to claim 16, in which the sector pieces include interlocking portions along their adjacent radial edges.

18. The apparatus according to claim 16 in which the central piece interlocks with the sector pieces.

19. The apparatus according to claim 13, in which the dice are formed of dodecahedron.

20. The apparatus according to claim 19, in which the dodecahedron have pentagonal facets with straight edges between adjacent facets.

21. The apparatus according to claim 19, in which the dodecahedron have curved transitions between adjacent facets.

* * * * *